United States Patent [19]

Copperman

[11] 4,374,446

[45] Feb. 22, 1983

[54] VACUUM NOZZLE FOR CARPETED STAIR TREADS AND RISERS

[75] Inventor: Marcus Copperman, University Heights, Ohio

[73] Assignee: Certified Chemical & Equipment Co., Cleveland, Ohio

[21] Appl. No.: 250,563

[22] Filed: Apr. 3, 1981

[51] Int. Cl.[3] ..... A47L 9/06

[52] U.S. Cl. ..... 15/415 A; 15/416

[58] Field of Search ..... 15/416, 415 R, 415 A, 15/322, 395, 398, 419

[56] References Cited

U.S. PATENT DOCUMENTS

| | | | |
|---|---|---|---|
| 1,318,881 | 10/1919 | Kelley | 15/415 A X |
| 2,606,338 | 8/1952 | De Lorenzo | 15/395 |
| 3,358,317 | 12/1967 | Woodruff | 15/419 X |
| 3,936,902 | 2/1976 | Shackleton et al. | 15/304 |
| 4,075,733 | 2/1978 | Parise et al. | 15/322 |
| 4,332,051 | 6/1982 | La Monte | 15/328 |

FOREIGN PATENT DOCUMENTS

| | | | |
|---|---|---|---|
| 511102 | 3/1955 | Canada | 15/395 |
| 1096006 | 12/1960 | Fed. Rep. of Germany | 15/415 A |
| 104536 | 5/1942 | Sweden | 15/419 |

*Primary Examiner*—Chris K. Moore

*Attorney, Agent, or Firm*—Jay M. Cantor

[57] ABSTRACT

A suction nozzle is provided which is comprised of a one piece outer cylindrical body member of predetermined fixed dimensions provided with an internal movable sleeve for adapting the nozzle to effectively and more conveniently extract dirt from carpeted stair treads or riser without changing the dimensions of the nozzle.

7 Claims, 5 Drawing Figures

VACUUM NOZZLE FOR CARPETED STAIR TREADS AND RISERS

BACKGROUND OF THE INVENTION

1. Field of the Invention

The present invention relates to an improvement in a vacuum nozzle used in cleaning carpets. The improved nozzle is constructed for efficient use on carpeted stair treads and stair risers.

2. Description of the Prior Art

The conventional nozzle used for vacuuming carpet has a port in conjunction with a handle attached to a source of vacuum by means of a hose that makes it possible to provide good suction action for removing foreign matter from the carpet while moving the port in contact with the carpet back and forth. The handle is of a length allowing the operator to work from an upright position with the vacuum hose trailing behind as he holds the handle in his hand.

In the prior art no attempt has been made to locate the nozzle at one end of the nozzle body and adjust the length of the port to a stair width or riser height. The following patents relating to nozzles having movable suction opening are known: U.S. Pat. Nos. 2,222,675 (Lynch); 2,758,331 (Gerber) 2,296,462 (Betts) and 3,608,126 (Tacoma et al). In all of the above patents, the area of nozzle opening is varied to change the velocity of air flow therethrough. They do not teach the concept of the present invention, which is to provide a suction nozzle constructed in such a way to have an opening in contact with the horizontal stair tread or vertical riser with simple change of opening in the nozzle so that this contact can be affected conveniently and without undue resistance of the vacuum hose attached to the nozzle handle. The nozzle of the present invention is especially useful in "steam" or hot water extraction cleaning. That is, a hot detergent liquid under pressure is projected against the carpet covering a stair tread or riser to loosen dirt and the nozzle removes the liquid and the dirt while the latter is held in suspension in the liquid. For a complete description of the "steam" or hot water extraction cleaning process for carpets, attention is called to U.S. Pat. No. 3,711,891 issued Jan. 23, 1973 to Joseph D. Conway entitled "Jet-Vibrator Vacuum System and Method".

SUMMARY OF THE INVENTION

It is therefore an object of this invention to provide an improved elongated suction nozzle having an elongated opening at one end thereof and for changing the effective length of said opening.

It is another object of the invention to provide a suction nozzle which can be adjusted from a length corresponding to the width of a carpeted stair tread to the height of the stair riser and vice versa.

It is a further object of this invention to provide a jet cleaning solution to emulsify and loosen the soil in the carpet for removal by suction.

In carrying out the objects of the invention an outer substantially cylindrical hollow body is provided with an elongated slot in the wall thereof extending axially from one end of the body. The body terminates at its other end in an extension lying at an angle to the axis for connection to a source of suction and which provides a handle for the nozzle simulating a "pistol grip" therefor. A cylindrical insert is frictionally held within the body and is manually rotated therein by means of a cap closing the insert at said one end but which is accessible exteriorly of said one end of the body. The wall of the cylindrical insert is provided with a plurality of angularly spaced secondary slots extending from the end corresponding to said one end of the body. The secondary slots are of different lengths and the length of the longest secondary slot is shorter than the slot in the body. By rotating the cap, any one of the secondary slots may be moved into registry with the opening in the hollow body. The length of all but one of the secondary slots corresponds to various stair widths respectively and the remaining secondary slot corresponds to the conventional height of a stair riser.

The novel structure for carrying out the concept of my invention can best be understood from the following description with references to the drawings in which:

DESCRIPTION OF THE PREFERRED EMBODIMENT

Figures 1, 2, 3, 4, 5:
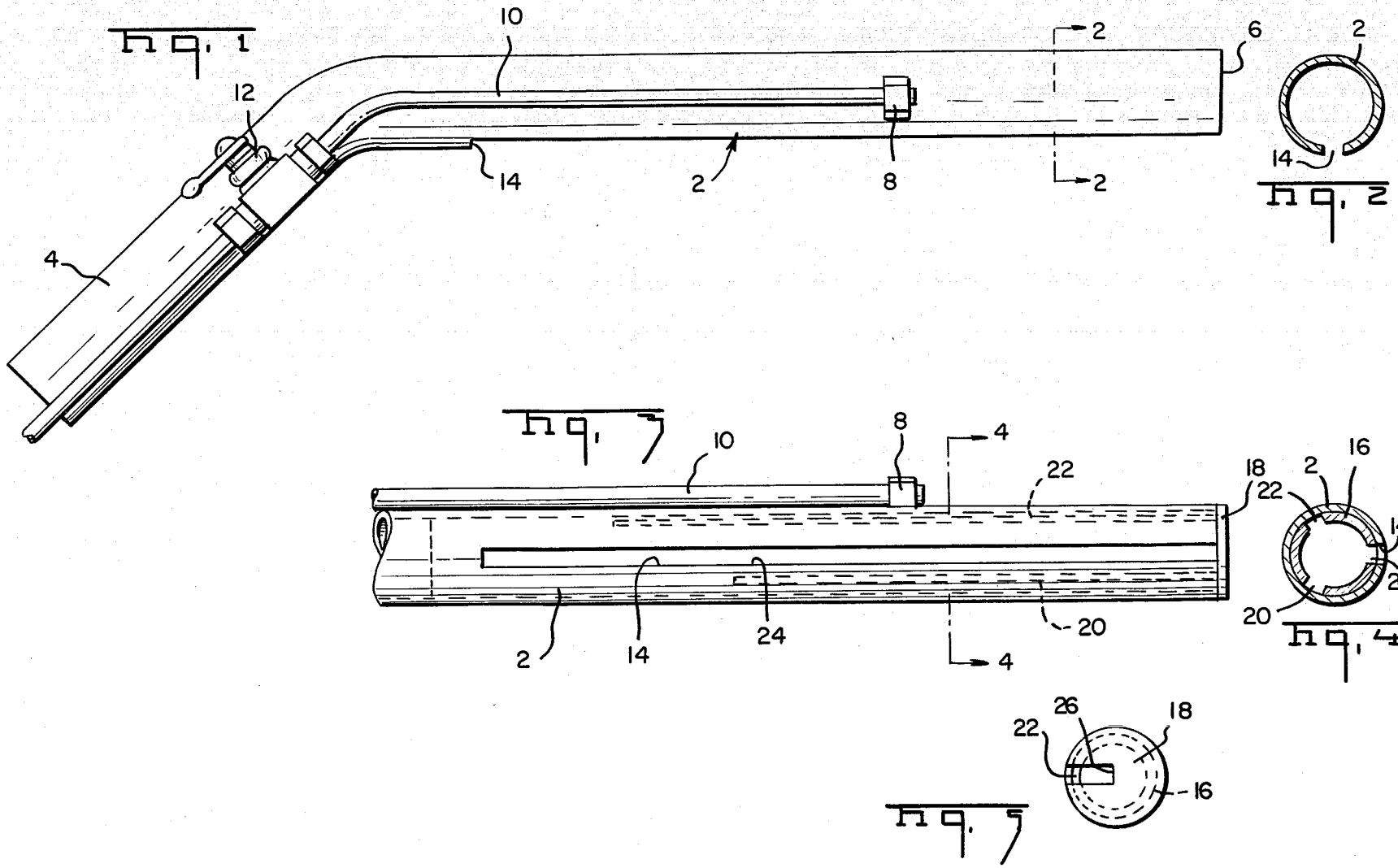
FIG. 1 is a top view of the suction nozzle with a jet spray assembly secured thereto.
FIG. 2 is a cross-section of the nozzle per se without an insert therein along line 2—2 of FIG. 1.
FIG. 3 is a bottom view of the nozzle having the rotatable insert therein, the axial slots in the latter being shown by the dotted lines.
FIG. 4 is a cross-section of the nozzle of FIG. 3 along the line 4—4.
FIG. 5 is an end view of a cap secured to one end of the insert shown in FIG. 4.

Referring to FIG. 1, the nozzle 2 is shown as a cylindrical body which terminates at one end in a bent portion at an angle to the axis of the body and in the same plane therewith so as to form a handle, the other end 6 being open. Secured to the exterior wall of the cylindrical body 2 and designated as the top wall of the body, is a spray tip 8 to which is connected a conduit 10 extending along the wall of the cylindrical body and which is connected to a source of hot cleaning solution or steam under high pressure as disclosed above by U.S. Pat. No. 3,711,891 through a toggle solution valve 12 located alongside the handle 4. The wall of cylindrical body 2 has a slot 14 extending axially from the end 6 at the bottom thereof as shown in FIG. 2.

Inserted within the cylindrical body 2 with a friction fit is a hollow tubular sleeve designated at 16. The sleeve is of a length so that its inner end extends beyond the end of the slot 14 remote from end 6 of the outer body member when the outer end of the sleeve is flush with end 6 of outer member 2. The sleeve 16 is capable of being manually rotated by means of a cap member 18, welded or otherwise secured to the outer end of tubular insert 16. The cap member has a larger diameter than the outer cylindrical body member 2 so that it abuts the end 6 to substantially close it off when the tubular insert is within the body member and forms a knob for rotatably adjusting the sleeve 16 manually.

Angularly spaced slots 20, 22 and 24 in the wall of insert 16 extend in an axial direction from the outer end thereof for different respective distances. Slot 24 extends for the full length of opening 14 in the outer body member 2. The slot 22 extends for a distance which is equal to the width of an average stair tread while slot 20 extends for a distance equal to the height of a standard stair riser. Although the sleeve insert 16 is shown in FIG. 3 as provided with three angularly spaced slots in its wall it is obvious that more slots may be provided of different lengths to correspond to stair treads of different respective widths which may vary from the average width of stair tread.

The end cap member 18, which may comprise a circular disc is provided with a slot 26 extending radially from its periphery into communication with the interior of the sleeve 16. The slot 26 may be aligned with the slot or opening 22 of the sleeve 16, so that when the sleeve is rotated to register elongated opening 22 with the opening 14 in the outer member 2 for extracting dirt from the carpet on a stair tread and the nozzle is in horizontal position and moved longitudinally along the tread with the end cap against the riser, the opening 26 is moved along the corner formed by the tread and riser to extract dirt from such corner by suction. Obviously, the slot or opening 26 may instead, be located in alignment with opening 20 if desired. To extract dirt from the riser the sleeve 16 is rotated to register opening 20 with opening 14 since the nozzle is held in a vertical position against the riser with the end cap in contact with the tread. The slot or opening 26 would then also operate to extract dirt from the corner formed by the tread and riser.

Operation of my nozzle to extract dirt from either a carpet supported on a floor or on a stair tread or riser should be obvious from the above description. When utilized to extract dirt from a carpeted tread or riser by use of steam or hot water the sleeve 16 is rotated to register opening 22 or 20 with opening 14, the valve 12 is opened to permit the cleaning solution under pressure to pass to the jet spray nozzle 8 which projects a fan-shaped spray against the carpeted area forwardly of the movable nozzle as disclosed by the aforementioned U.S. Pat. No. 3,711,891. The dirt is then loosened and is suspended in the cleaning solution. A suction force supplied through the handle 4 in a well-known manner causes the solution and loose and suspended dirt to be extracted from the carpet. The simulated pistol grip 4 renders it easy to manipulate the nozzle by hand thus rendering it unnecessary to use a wand to manipulate the nozzle in either a vertical or horizontal position.

Having thus described the invention with the particularity required by the statutes it should be understood that obvious changes may be made therein without departing from the spirit and scope of the invention as defined by the following claims.

I claim:

1. A nozzle for cleaning a carpeted stair tread and riser comprising a hollow cylindrical body having a hollow extension in one end for connection to a source of suction, said body having an elongated port in its wall extending from the other end thereof and adjusted to lie against a surface having matter to be removed by said suction, and valve means cooperating with said body for selectively restricting the axial length of the passageway through said port to the width of a stair tread or a stair riser, said valve means comprising a hollow cylindrical sleeve member which conforms in size and shape to the inner wall of said body and being selectively rotatably mounted therein with a friction fit.

2. A nozzle according to claim 1 wherein said hollow extension is directed at an angle to said cylindrical body in the plane thereof and forms a handle therefor simulating a pistol grip.

3. A nozzle for cleaning a carpeted stair tread and riser comprising a hollow cylindrical body having a hollow extension in one end for connection to a source of suction, said body having an elongated port in its wall extending from the other end thereof and adjusted to lie against a surface having matter to be removed by said suction, and valve means cooperating with said body member for selectively restricting the length of the passageway through said port to the width of a stair tread or a stair riser, said valve means comprising a hollow cylindrical sleeve member which conforms in size and shape to the inner wall of said body and is rotatably mounted therewith with a friction fit wherein the wall of said sleeve member is provided with a plurality of slots extending axially from the outer end thereof and which are angularly spaced, said slots being of different lengths, one of said slots corresponding to the length of a stair riser and another of said slots corresponding to the width of a stair tread.

4. A nozzle according to claim 3 including a closure cap secured to the outer end of the cylindrical sleeve member, said cap providing a handle for moving said valve to locate a selected slot in registration with said port in the cylindrical body member.

5. A nozzle according to claim 4 wherein said cap is provided with a radially extending slot at its peripheral edge for applying suction to the corner formed by a stair tread and riser.

6. A nozzle according to claim 4 including a liquid jet spray nozzle secured to the exterior wall of said body member having means for connecting it to a source of cleaning liquid for applying said liquid to the carpet to be cleaned.

7. A nozzle according to claim 6 including a manually operated valve secured to the outer wall of the cylindrical body for controlling flow of cleaning fluid to said spray nozzle.

* * * * *